US005542597A

United States Patent [19]

Richards

[11] Patent Number: 5,542,597

[45] Date of Patent: Aug. 6, 1996

[54] PRECUT WRAPPING PAPER FOR WRAPPING PACKAGES

[75] Inventor: Barbara A. Richards, Matthews, N.C.

[73] Assignee: Gordon R. Richards, Matthews, N.C.; a part interest

[ * ] Notice: The term of this patent shall not extend beyond the expiration date of Pat. No. 5,414,976.

[21] Appl. No.: 425,140

[22] Filed: Apr. 19, 1995

Related U.S. Application Data

[63] Continuation of Ser. No. 170,039, Dec. 20, 1993, Pat. No. 5,414,976, which is a continuation-in-part of Ser. No. 801, 497, Oct. 6, 1992, abandoned.

[51] Int. Cl.[6] ..... B65D 65/10; B65D 65/14

[52] U.S. Cl. ..... 229/116.5; 229/87.19

[58] Field of Search ..... 229/87.19, 87.18, 229/923, 116.5

[56] References Cited

U.S. PATENT DOCUMENTS

| | | | |
|---|---|---|---|
| 147,548 | 2/1874 | Beecher . | |
| 1,149,412 | 8/1915 | Smith . | |
| 1,249,607 | 12/1917 | Ferguson | 229/87.18 |
| 1,364,897 | 1/1921 | Smith . | |
| 1,364,899 | 1/1921 | Smith . | |
| 2,365,704 | 12/1944 | James . | |
| 2,438,509 | 3/1948 | McGovern . | |
| 3,366,313 | 1/1968 | Culberg et al. . | |
| 5,186,988 | 2/1993 | Dixon | 229/87.19 |
| 5,306,372 | 4/1994 | Hall et al. | 229/87.19 |
| 5,414,976 | 5/1995 | Richards | 229/87.19 |

*Primary Examiner*—Stephen P. Garbe

*Attorney, Agent, or Firm*—Bell, Seltzer, Park & Gibson, P.A.

[57] ABSTRACT

Pre-cut and pre-taped sheets of wrapping paper are provided to wrap boxes of corresponding size to form packages. All sheets of the pre-cut paper include extensions that extend beyond the sides of a box being wrapped and are easily folded inwardly against the ends of the box during wrapping of the package.

4 Claims, 3 Drawing Sheets

PRECUT WRAPPING PAPER FOR WRAPPING PACKAGES

This application is a continuation of application Ser. No. 08/170,039, filed Dec. 20, 1993, now U.S. Pat. No. 5,414,976 which is a continuation-in-part of Ser. No. 07/801,497, filed Oct. 6, 1992, now abandoned.

FIELD OF THE INVENTION

This invention relates to the packaging of containers.

BACKGROUND OF THE INVENTION AND STATEMENT OF PRIOR ART

The conventional wrapping of packages requires a number of separate steps using a variety of wrapping materials. Specifically, a suitable box, suitable paper, and string or pressure sensitive tape for holding the paper on the box must be provided. Then, the paper must be cut to conform to the size and shape of the box. Then, the paper is folded around the box and temporarily held in place while the string or pressure sensitive tape is manipulated to fasten the paper to the box.

U.S. Pat. No. 3,366,313 issued Jan. 30, 1968 to Culberg et al. for ARRANGEMENT FOR WRAPPING PACKAGES. Culberg discloses an improvement on the aforesaid conventional wrapping of packages, the improvement comprising the pre-cutting of wrapping paper in sheets of apparently a single predetermined size and the placement of short strips of pressure sensitive adhesive at selected points on the edges of the pre-cut paper.

The strips of adhesive are initially covered with strips of correspondingly dimensioned release paper, which are individually removed to use the adhesive while forming the package and to seal the package.

Culberg discloses two embodiments of his invention. In the embodiment illustrated in FIGS. 1–5, Culberg folds the paper at about its midpoint to bring opposing edges of the paper together. The opposing edges are adhered together to form a tubular sheath. A box is inserted in the sheaf and one side of the box is urged against the folded portion of the paper. A portion of the paper adjacent the opposing edges is folded flat against a second side of the box opposite said one side and the opposing edges are then folded over the second side of the box.

In Culberg's second embodiment, illustrated in FIGS. 6–8, he again provides short strips of pressure sensitive adhesive at selected points on the edges of pre-cut rectangular sheets of paper. But, in the second embodiment, Culberg forms the package in the usual way by folding one longitudinal edge of the pre-cut sheet of paper over one side of a box far enough so that said one longitudinal edge extends along the middle of the box being wrapped. The opposing longitudinal edge of the paper is then folded into overlapping relation with the first longitudinal edge portion of the paper and an adhesive strip on the second longitudinal edge is brought into contact with the first longitudinal edge portion to hold the paper around the sides of the box.

The paper is then folded over tile ends of the box and held in place by removing the release paper on strips of adhesive that are provided on the pre-cut paper.

SUMMARY OF THE INVENTION

The present invention improves on Culberg by pre-cutting sheets of paper into a variety of sizes to conform with the various standard sizes of boxes, such as shirt boxes, and miscellaneous sizes of boxes.

Applicant's pre-cut sheets of paper are pre-taped with covered strips of pressure sensitive tape, and are preferably matched with boxes of corresponding size to form individual wrapping units.

Another advantage of applicant's invention over the known prior art is the inclusion of extensions on each pre-cut sheet of paper. The extensions are shaped and positioned on each sheet to fold over and extend beyond the sides of a box being wrapped. The advantage of the extensions is that they facilitate folding the paper about the ends of the box to complete the package.

Strips of pressure sensitive tape, covered with release paper, are spaced inwardly from the edges of those portions of the paper that will overlie the ends of the box. Other strips of pressure sensitive tape are spaced inwardly from the edges of those portions of the paper that will overlie the medial portion of the box.

Different sizes of applicant's pre-cut and pre-taped paper sheets may be combined and sold in a combination pack for the convenience of the user in matching a selected box with the corresponding size of applicant's pre-cut and pre-taped paper in the combination pack.

Alternatively, the pre-cut and pre-taped sheets of paper may be formed successively, with lines of perforations separating each sheet, and wrapped in a roll that is unwound and removed from the roll by the user as needed.

BRIEF DESCRIPTION OF THE DRAWINGS

FIGS. 5 through 8 being fragmentary views, with parts broken away, illustrating the sequential steps of folding and sealing the extensions on the pre-cut paper around an end of a box.

DETAILED DESCRIPTION OF THE INVENTION

Referring more specifically to the drawings, the numeral 10 broadly designates a pre-cut and pre-taped sheet of wrapping paper that has been formed in accordance with this invention.

The dimensions of the sheet of paper 10 are sufficiently greater than those of a selected box 11 (FIGS. 3 through 9) to permit wrapping of the box 11 with the paper 10 to form a satisfactory package.

Figure 1:
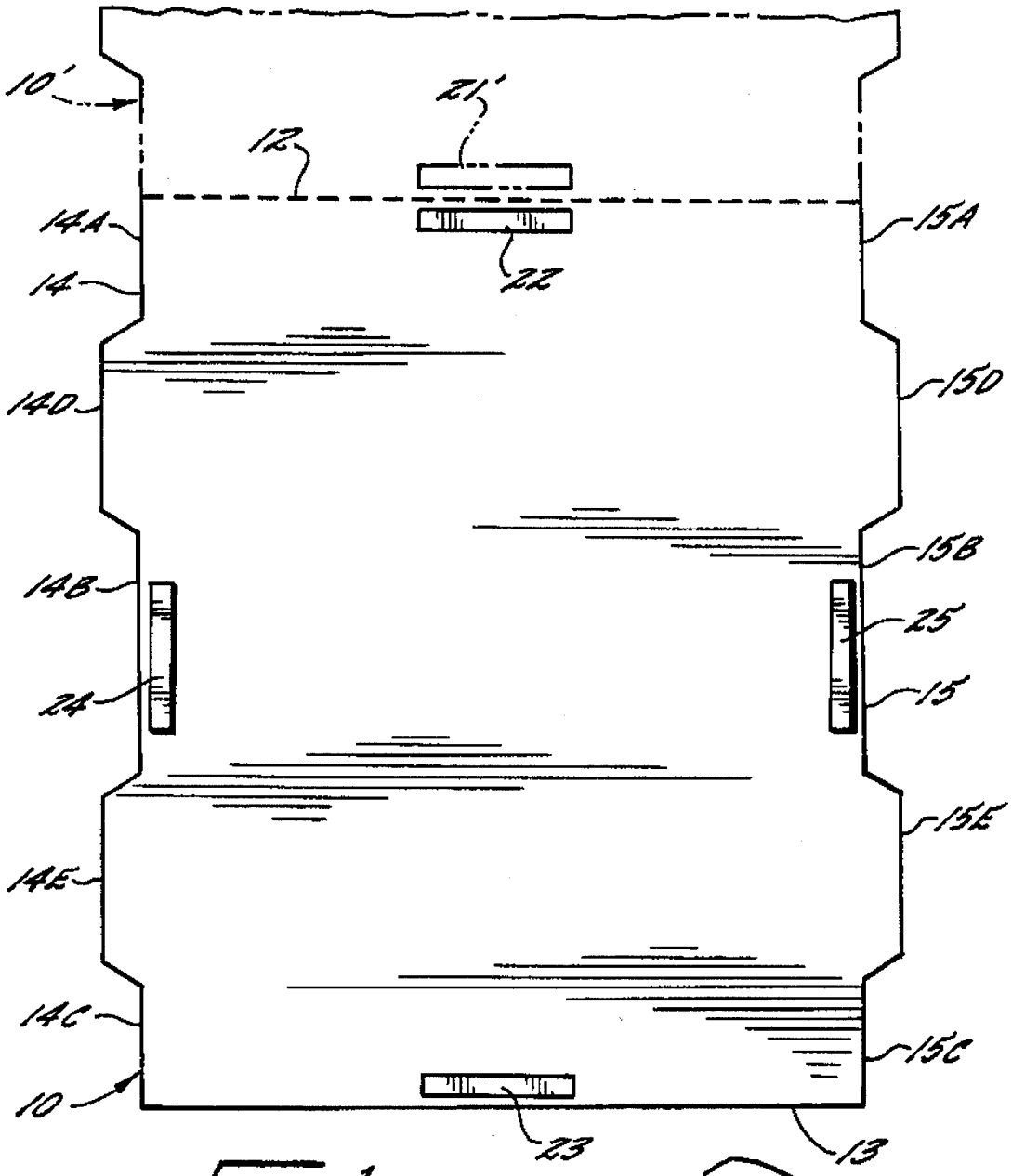
FIG. 1 is a top plan view of a pre-cut and pre-taped sheet of wrapping paper intended for a correspondingly sized box.

FIG. 1 shows the sheet of paper 10 with a perforated edge 12 separating the sheet of paper 10 from succeeding sheets of correspondingly pre-cut and pre-taped paper $\mathbf{10^1}$ that have been wrapped in a roll, not shown. If desired, the sheets of paper 10 can be formed individually and separately to be packed in stacks.

Each pre-cut and pre-taped sheet of paper 10 has opposed side edges 12 and 13 and opposed end edges 14, 15. The side edges 12, 13 are spaced apart sufficiently for those edges to slightly overlap when the paper 10 is wrapped about the circumference of an appropriately sized box 11, as in FIG. 4.

Unlike the side edges 12, 13, which are cut a long straight lines, parallel to each other, the end edges 14, 15 are cut along irregular lines to define alternating inner segments and outer segments.

End edge 14 has inner segments 14A, 14B and 14C, with an outer segment 14D between inner segments 14A and 14B and an outer segment 14E between inner segments 14B and 14C. End edge 15 has inner segments 15A, 15B and 15C, with an outer segment 15D between inner segments 15A and 15B and an outer segment 15E between inner segments 15B and 15C.

Figure 3:
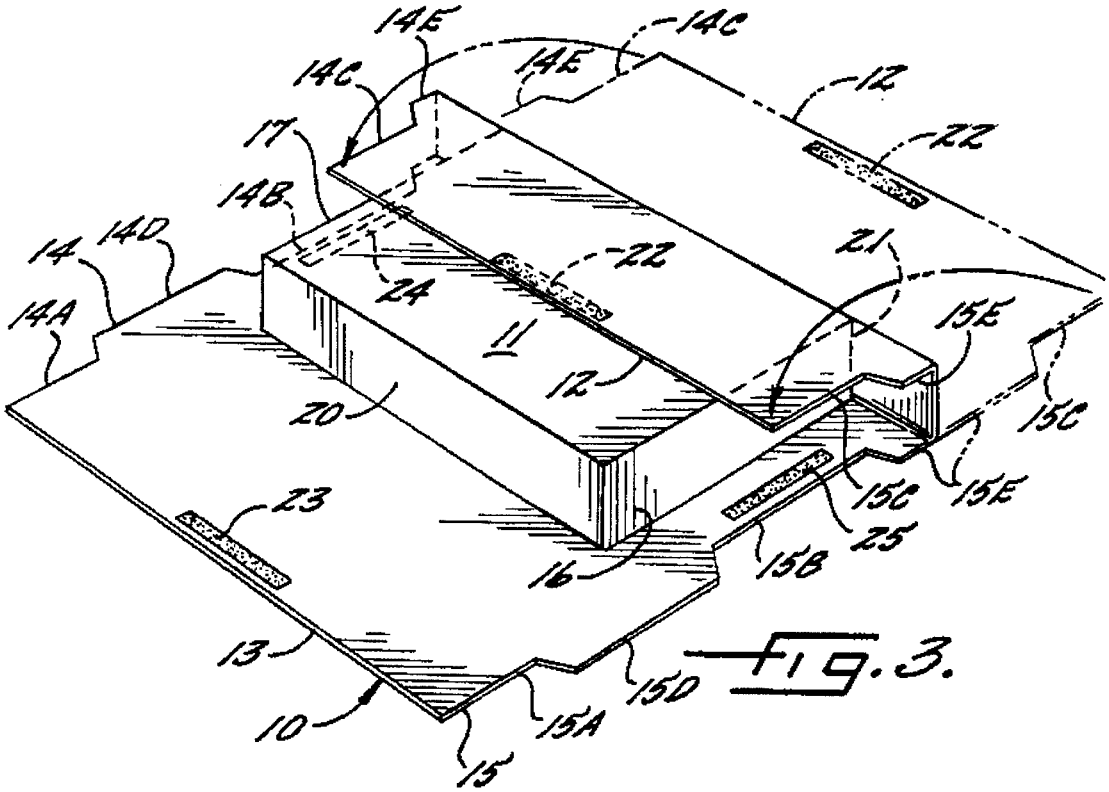
FIGS. 3 through 8 are sequential perspective views illustrating the wrapping of a sheet of pre-cut and pre-taped paper about a correspondingly sized box.
Figure 4:
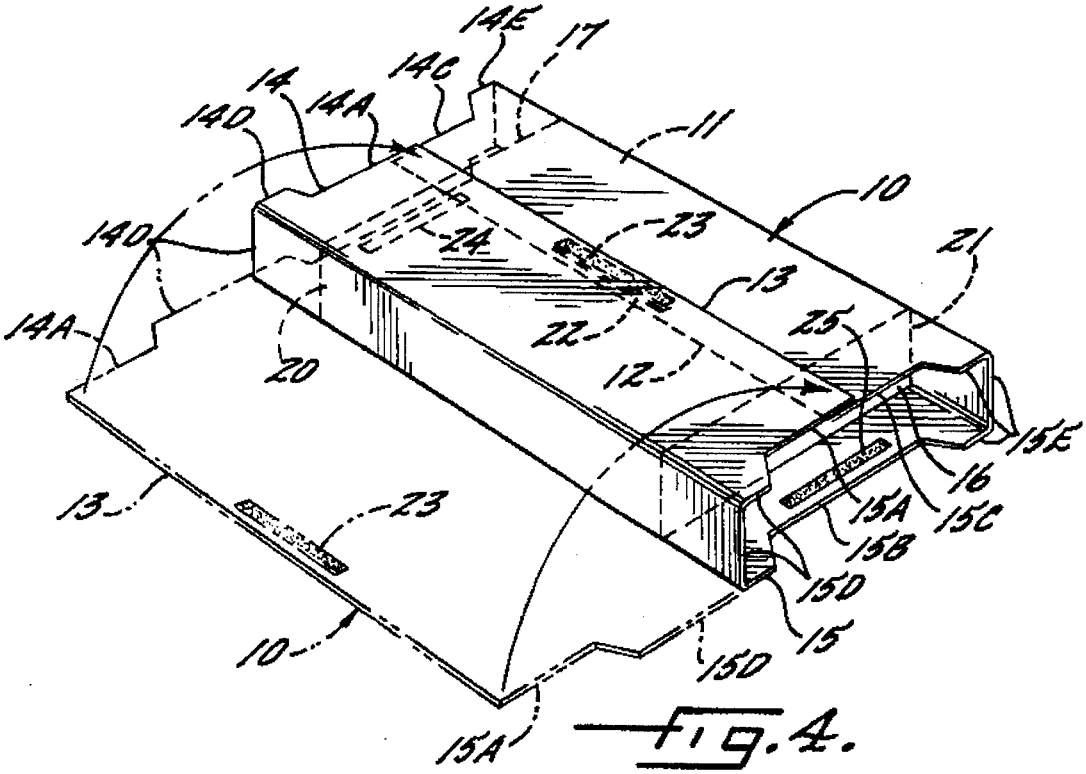

The end edges 14, 15 are spaced apart sufficiently for all segments of those edges to extend beyond opposing ends 16 and 17 of an appropriately sized box 11 when the paper 10 is wrapped about the circumference of the box 11, as in FIGS. 3 and 4.

The outer segments 14D, 14E and 15D, 15E are spaced along their respective end edges 14 and 15 to extend beyond side walls 20 and 21, respectively, of the selected box 11 when the paper 10 is initially wrapped around the circumference of the box 11, as shown in FIGS. 3 and 4.

Figure 2:
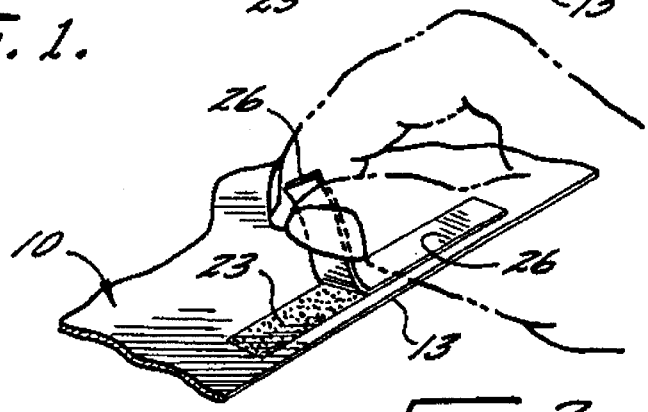
FIG. 2 is an enlarged fragmentary view of the lower edge of the paper in FIG. 1, with parts broken away, and illustrating the manual removal of the release paper, or protective cover, from a strip of pressure sensitive tape fastened to the pre-cut and pre-taped paper.

The paper sheets 10 are pre-cut as described for the purpose of facilitating the wrapping of a box to form a package. The wrapping of a box is further facilitated by the provision of pre-cut strips of pressure sensitive adhesive tape 22, 23, 24, and 25 strategically placed in inwardly spaced relation to respective edges 12, 13, 14, and 15. FIG. 2 shows a cover of release paper 26 overlying the pressure sensitive adhesive 23 and illustrates the manual removal of the release paper 26 when it is desired to activate the adhesive to bond the paper to a box, as in FIG. 3, or to bond the paper to itself, as in FIGS. 4 and 9. Each of the strips 22, 23, 24, and 25 are provided with a similar cover of release paper 26.

The pressure sensitive strip of adhesive 22 adheres the portion of the paper 10 adjacent the edge 12 to the box 11 during the initial wrapping of the paper about the box 11, as shown in FIG. 3. After the edge 13 of the paper 10 is brought into overlapping relation to the edge 12 of the paper 10, the adhesive strip 23 is activated to bond the edge 13 in overlying relation to the edge 12 of the paper 10 (FIG. 4).

FIGS. 5 through 8 illustrate the steps in folding the paper adjacent edge 15 into position against the end 16 of the box. The paper adjacent its edge 14 is similarly folded into position against the opposite end 17 of the box.

Figure 5:
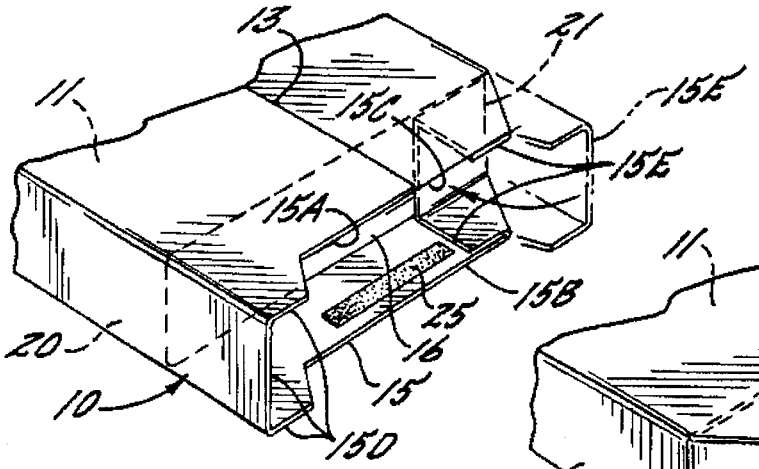
Figure 6:
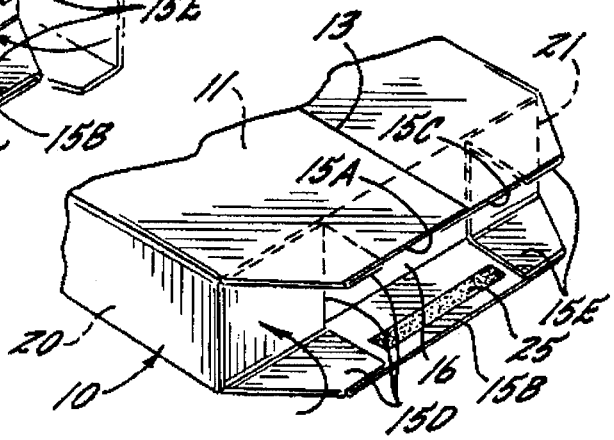
Figure 7:
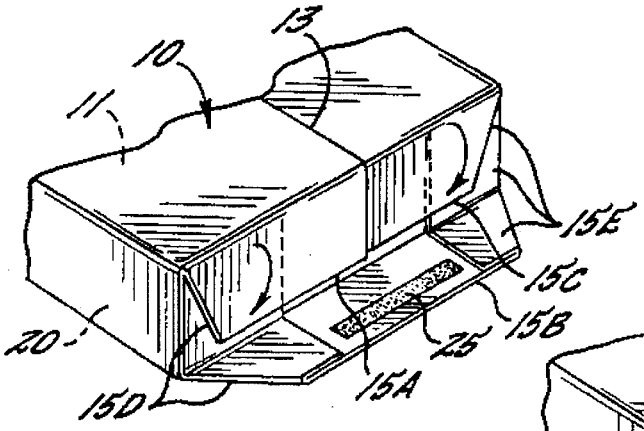
Figure 8:
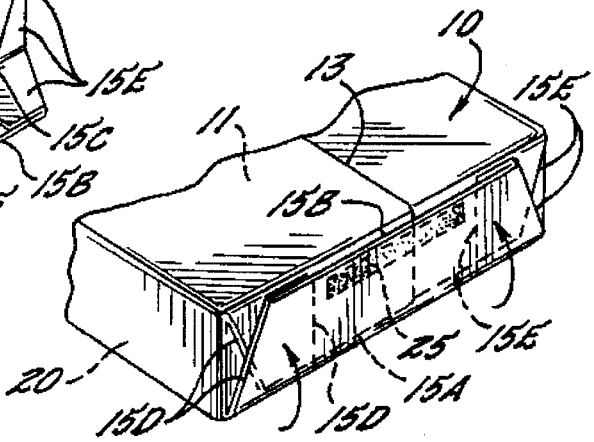

The first step in folding the paper against the ends of the box, as in FIGS. 5 and 6, is to fold the medial portions of outer segments 14D, 15D and 14E, 15E inwardly against respective ends 17, 16 of the box 11 and the remaining portions of the outer segments into contiguous relation to the inner segments 15B and 15C to form gusset folds. The inner segments and the remaining portions of the outer segments define top and bottom flaps which are then folded into overlying relation with the medial portions of the outer segments and with the respective ends 16, 17 of the box 11 (FIGS. 6, 7, and 8).

Figure 9:
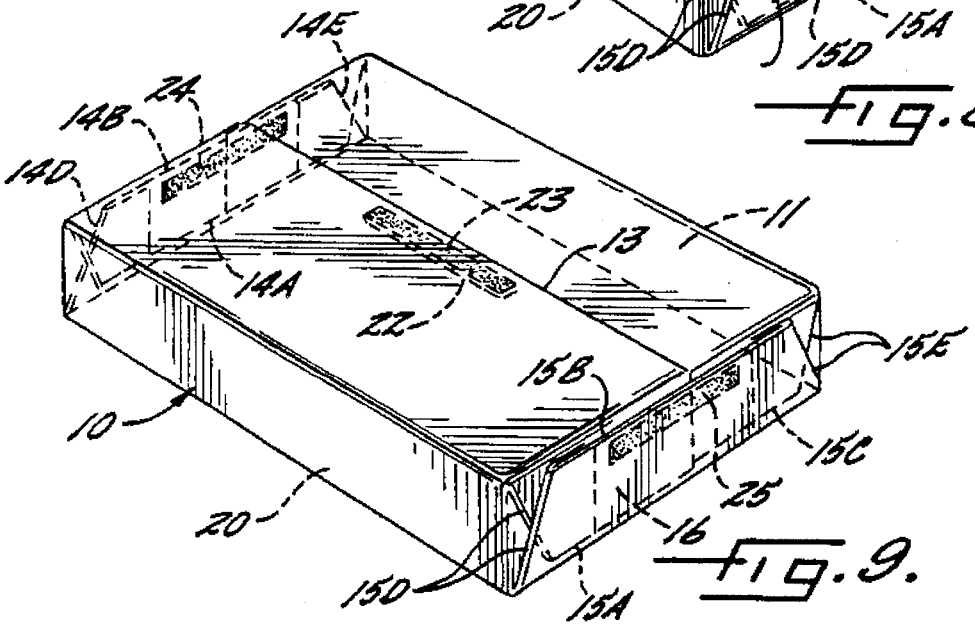
FIG. 9 is a perspective view of a completed package, wrapped in accordance with the invention.

The completed package is shown in FIG. 9.

Although specific terms have been used in describing the invention, they have been used in a generic and descriptive sense only and not for the purpose of limitation, the scope of the invention being determined by the following claims to invention when considered with this specification and the drawings and with the prior art.

I claim:

1. A sheet of wrapping paper characterized by being adapted to wrap an item of a selected size without the removal of any portion of the sheet and without any substantial excess material, said sheet comprising a generally rectangular sheet of paper pre-cut to a predetermined size having a widthwise dimension sufficient to wrap around an item with opposite side edge portions of said sheet overlapping for a relatively short distance and a lengthwise dimension sufficient to provide end portions of said sheet extending beyond opposite ends of the item being wrapped by predetermined distances, opposite end portions of said sheet having terminal end edges, each of which includes a first pair of spaced apart inner edge segments perpendicular to said side edges, a second pair of spaced apart outer edge segments spaced outwardly from said first inner edge segments and a third inner edge segment between said outer edge segments, said spaced apart inner edge segments being aligned widthwise of said sheet and with corresponding opposite inner edge segments lengthwise of said sheet and said second pair of spaced apart outer edge segments being aligned widthwise of said sheet and with corresponding opposite outer edge segments lengthwise of said sheet, said second pair of end edge segments being adapted to be disposed at the corners of the item being wrapped and to extend outwardly therefrom and being further adapted to be folded inwardly between the remaining end portion of said sheet to form gusset folds and when so folded to have the outer edges thereof contiguous with said first and third inner edge segments, and strips of adhesive secured to one surface of said sheet adjacent opposite end edges of said sheet and adjacent at least one of said opposite side edges thereof to secure said sheet of paper about an item when said sheet is wrapped therearound.

2. A wrapped package comprising a box adapted to contain a gift item or the like and comprising top, bottom, side and end walls, a sheet of wrapping paper wrapped tightly about said box and comprising an integral, generally rectangular sheet of paper having a widthwise dimension slightly greater than the sum of the transverse dimensions of said top, bottom and side walls of said box such that opposite side edge portions of said sheet overlap along a medial lengthwise portion of one of said top and bottom walls, said sheet having a lengthwise dimension greater than the lengthwise dimension of said top and bottom walls and defining end portions which initially extend outwardly beyond the end walls of said box, each of said end portions comprising top and bottom flaps and gusset folds between and connecting said top and bottom flaps, each of said gusset folds including a first outer section which initially extends outwardly beyond the end wall of the box a greater distance than said top and bottom flaps and is folded inwardly between said top and bottom flaps into contiguous relation with the end wall of said box, said gusset fold also including second and third outer sections connecting the first section to said top and bottom flaps and being folded into contiguous relation with said top and bottom flaps, the outer edges of said second and third outer sections of said gusset folds being parallel to and in alignment with the outer edges of said top and bottom flaps, said bottom flap and said third outer section of said gusset folds being folded into contiguous relation to the end wall of said box and to the first outer sections of said gusset folds, and said top flap and said second outer sections of said gusset folds being folded into contiguous relation to said end wall of said box, said bottom flap and said first sections of said gusset folds, and adhesive strips located between said overlapped side edge portions and between said top and bottom flaps to secure said sheet about said box.

3. A web of wrapping paper comprising a plurality of interconnected sheets pre-cut to a predetermined size and adapted to wrap boxes of a selected size, an adjacent pair of sheets in said web being connected along a tear line for ease of separation of a sheet from said web, each of said sheets having a dimension lengthwise of said web sufficient to exceed by a small amount the circumferential dimension laterally around a box to be wrapped and a dimension widthwise of said web exceeding the lengthwise dimension of a box to be wrapped by amounts such that end edges of said sheet will project beyond the ends of a box when the sheet is wrapped therearound, each sheet having end edges which include three inner edge segments which are aligned lengthwise of said web and have disposed therebetween projecting outer edge segments which are adapted to be disposed at and extend outwardly from the corners of a box when said sheet is wrapped therearound, said projecting outer edge segments being adapted to be folded into gusset folds between the remaining end portions and to terminate coterminous with said three inner edge segments when so folded, and adhesive strips mounted on one surface of each of said sheets adjacent said end edges and adjacent at least one of the side edges thereof for securing said sheet about a box when said sheet is wrapped therearound.

4. A sheet of wrapping paper according to claim 1 wherein said first, and third inner edge segments are connected to said outer edge segments by end edge segments which extend therebetween at an obtuse angle to said first and third inner edge segments.

* * * * *